US008230831B2

(12) United States Patent
Persson et al.

(10) Patent No.: US 8,230,831 B2
(45) Date of Patent: Jul. 31, 2012

(54) EXHAUST VALVE MECHANISM FOR INTERNAL COMBUSTION ENGINE

(75) Inventors: Per Persson, Partille (SE); Hans Bondeson, Mölnlycke (SE); Anders Nobelius, Göteborg (SE); Johan Grankvist, Göteborg (SE)

(73) Assignee: Volvo Lastuaguar AB, Göteborg (SE)

( * ) Notice: Subject to any disclaimer, the term of this patent is extended or adjusted under 35 U.S.C. 154(b) by 1511 days.

(21) Appl. No.: 11/466,473

(22) Filed: Aug. 23, 2006

(65) Prior Publication Data

US 2007/0028878 A1 Feb. 8, 2007

Related U.S. Application Data

(63) Continuation of application No. PCT/SE2005/000179, filed on Feb. 9, 2005.

(30) Foreign Application Priority Data

Feb. 23, 2004 (SE) ..... 0400453

(51) Int. Cl.
*F01L 1/34* (2006.01)

(52) U.S. Cl. ..... 123/90.16; 123/90.39

(58) Field of Classification Search ..... 123/90.16, 123/90.39, 90.15

See application file for complete search history.

(56) References Cited

U.S. PATENT DOCUMENTS 6,439,195 B1 8/2002 Warner

FOREIGN PATENT DOCUMENTS

| | | | |
|---|---|---|---|
| DE | 4025569 | C1 * | 7/1991 |
| DE | 4142197 | A1 * | 4/1993 |
| EP | 1219791 | A2 | 3/2002 |
| WO | 03031778 | A1 | 4/2003 |

OTHER PUBLICATIONS

Abstract for DE 4025569.*
Abstract for DE 4142197.*
International Search Report from corresponding International Application PCT/SE2005/000179.
International Preliminary Examination Report from corresponding International Application PCT/SE2005/000179.

* cited by examiner

*Primary Examiner* — Zelalem Eshete
(74) *Attorney, Agent, or Firm* — WRB-IP LLP

(57) ABSTRACT

An exhaust valve mechanism for an internal combustion engine with at least one exhaust valve in every engine cylinder includes a main rocker arm mounted on a rocker arm shaft and a secondary rocker arm arranged on the main rocker arm and mounted on the rocker arm shaft for the activation of an exhaust brake function. A spring device is so arranged as to act between a fixed point on the engine and the secondary rocker arm, in such a way that the latter rocker arm is caused by the spring force to engage with the cam element of the camshaft.

4 Claims, 2 Drawing Sheets

EXHAUST VALVE MECHANISM FOR INTERNAL COMBUSTION ENGINE

BACKGROUND AND SUMMARY

The present application is a continuation of International Application No. PCT/SE2005/000179, filed Feb. 9, 2005, which claims priority to SE 0400453-7, filed Aug. 23, 2004, both of which are incorporated by reference.

The present invention relates to an exhaust valve mechanism for an internal combustion engine with at least one exhaust valve in each engine cylinder, which mechanism comprises a main rocker arm for each cylinder mounted on the rocker arm shaft for normal operation of the exhaust valve by the actuation of a camshaft with a cam element for each rocker arm and a secondary rocker arm arranged on the main rocker arm and mounted on a rocker arm shaft, for the activation of an exhaust brake function, which activation is achieved through the supply of hydraulic pressure to a piston cylinder which acts between both the rocker arms and takes place through the effect of one of the cam elements of the camshaft.

A valve mechanism in accordance with the foregoing is previously disclosed through WO 03/031778, for example, which can be utilized in conjunction with a special type of camshaft with exhaust cams with extra lobes to increase the braking effect of the engine. For example, it is possible to use a higher valve lift height, which gives a more effective gas exchange in the cylinder under engine braking. Such a valve mechanism can also take up greater forces, which means that a higher differential pressure can be permitted over the exhaust valve, which permits a significant increase in the braking effect.

When the exhaust valves in this previously disclosed valve mechanism are to open for the main lift (normal engine function), this is only performed via the main rocker arm. During this sequence, the secondary rocker arm can adopt any desired position between two outer end positions, where it is able in one extreme position to bear against its cam element, and in the other extreme position to accompany the main rocker arm. This angular interval, which is circa 10°, can cause undesired wear or damage to the valve mechanism, when the secondary rocker arm bears against either its cam element or the main rocker arm. Another problem is that the secondary rocker arm is subjected to unilateral loading under active engine braking, which reduces the thickness of the oil film at its bearing point, which can also lead to wear.

It is desirable to bring about an improvement in a valve mechanism of the kind indicated in the introduction, so that the above-mentioned problems can be avoided.

This is achieved in accordance with the invention in that a spring device is so arranged as to act between a fixed point on the engine and the secondary rocker arm, in such a way that the latter rocker arm is caused by the spring force to engage with the cam element of the camshaft.

Undesired movement in the secondary rocker arm during normal engine function is avoided by means of the invention. It is also possible to increase the oil film thickness at the bearing point of the secondary rocker arm by simple means.

BRIEF DESCRIPTION OF THE FIGURES

The invention is described in greater detail below with reference to the illustrative embodiments that are shown in the accompanying drawings, in conjunction with which.

DETAILED DESCRIPTION

Figure 1:
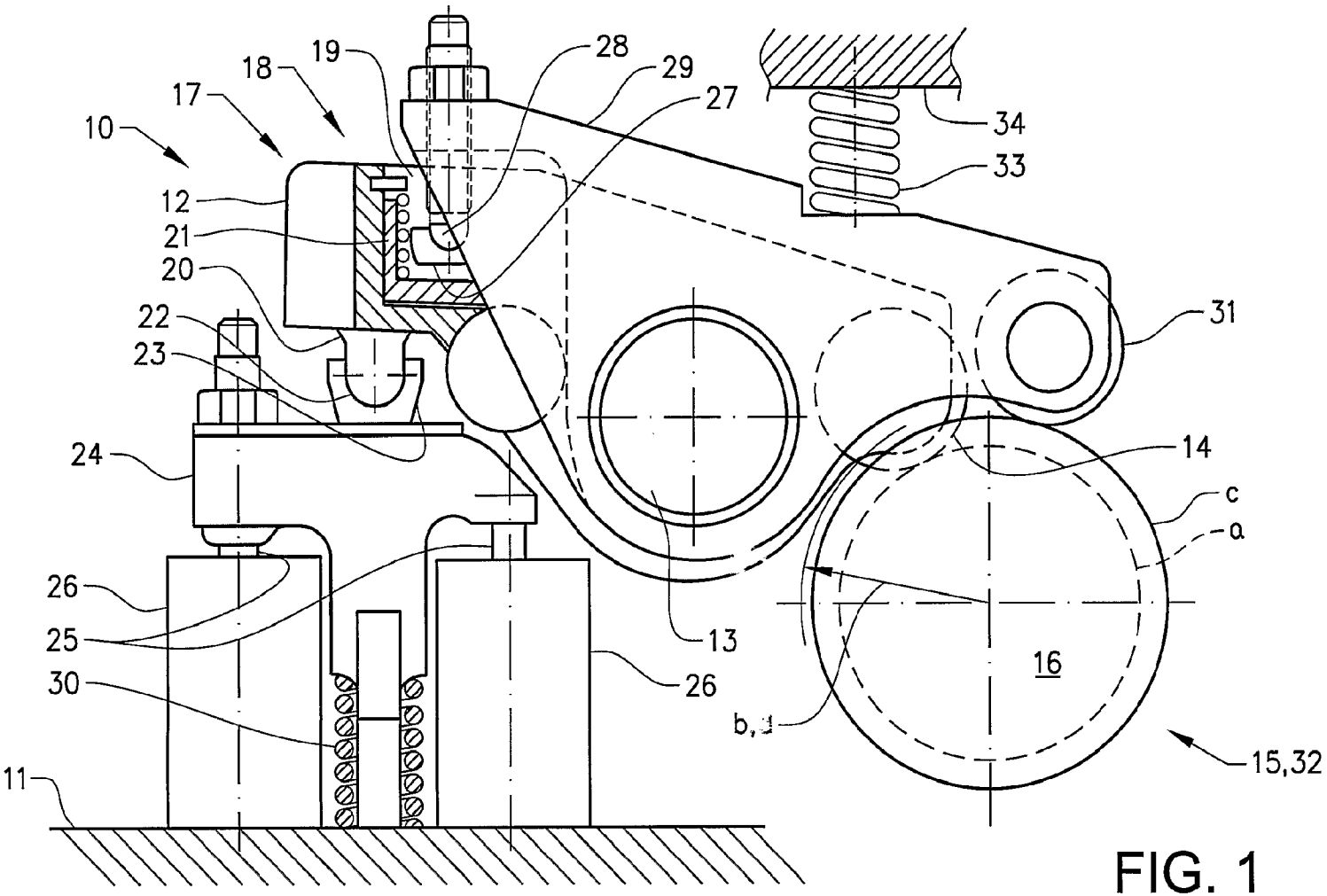
FIG. 1 is a side view of a valve mechanism executed in accordance with the invention.

FIG. 1 illustrates schematically a valve mechanism 10 for the operation of exhaust valves in an internal combustion engine 11. The mechanism 10 corresponds to the mechanism that is illustrated in WO 03/031778, FIGS. 2-4, and comprises a main rocker arm 12, which is mounted in such a way as to be capable of rocking on a rocker arm shaft 13. A cam follower roller 14 is rotatably mounted at one end of the main rocker arm 12. The cam follower roller 14 engages with a schematically illustrated cam element 15 on the camshaft 16. The base circle of the cam element 15 is designated with "a", and its top radius is designated with "b". At its end 17, which is opposite the end with the cam follower roller 14, the main rocker arm 12 is executed with a double-acting piston cylinder arrangement 18 consisting of two cylinder spaces 19 (of which one is shown vertically sectioned), formed at the end 17 of the rocker arm, with respective pistons 20,21 that are accommodated in the cylinder spaces.

The piston 20 is provided with a gudgeon pin 22 with a spherical end which projects into a guide 23 on a yoke 24, which, during operation, presses against two exhaust valve stems 25 under the effect of schematically represented valve springs 26. The piston 21 is so arranged as to act in the opposite direction and is provided with a guide 27 which accommodates the spherical end of an adjuster screw 28 that is mounted at one end of a secondary rocker arm 29, of which a brief description is given below. For a more detailed description, reference is made to the previously mentioned WO 03/031778.

Present in addition to the valve springs 25 is a further spring 30, the purpose of which is to hold the yoke 24 in a position such that the free play which is normally present in a valve mechanism of this kind, occurs between the ends of the spindles 25 and the underside of the yoke 24.

The secondary rocker arm 29 is mounted on the rocker arm shaft 13. A cam follower roller 31 is rotatably mounted at the end of the secondary rocker arm 29 opposite the adjuster screw 28. The cam follower roller 31 engages with a schematically illustrated cam element 32 on the camshaft 16. The base circle of the cam element is designated with "c", and its top radius with "d".

During normal engine operation, the pistons 20, 21 are situated at their inactive end positions. The transition to brake operation takes place in that a valve is closed and builds up a pressure in a hydraulic circuit which communicates with the cylinder spaces 19. In conjunction with this, the piston 20 is shown in the figures displaced downwards for adjustment of the valve free play to zero, at the same time as the piston 21 is shown in the figures displaced upwards to an upper end position against a stop ring in the illustrated cross- section of the cylinder space 19. It is now possible for cam lobes on the cam element 32 to actuate the main rocker arm via the secondary rocker arm, so that the exhaust valves are activated in accordance with previously disclosed technology for brake operation.

In order to prevent the secondary rocker arm 29 from moving in an uncontrolled fashion when it is inactive, a helically wound compression spring 33 is mounted in accordance with FIG. 1 at a fixed point 34 on the engine. The spring acts against the secondary rocker arm at a point which lies essentially mid way between its bearing shaft and the contact point of the cam follower roller 31 with the cam element so that the rocker arm, including in its inactive state, is caused by the spring force to make contact with the cam element. Because the secondary rocker arm 29, due to the rotation of the camshaft, is subjected to a loading alternately from below via the cam element 32 and alternately in the opposite direction via the compression spring 33, the rocker arm bearing will be subjected to load reversals, which makes it possible for the oil film to increase between the bearing bushing of the secondary rocker arm and the rocker arm shaft. This means that the wear in the mechanism can be reduced significantly.

Figure 2:
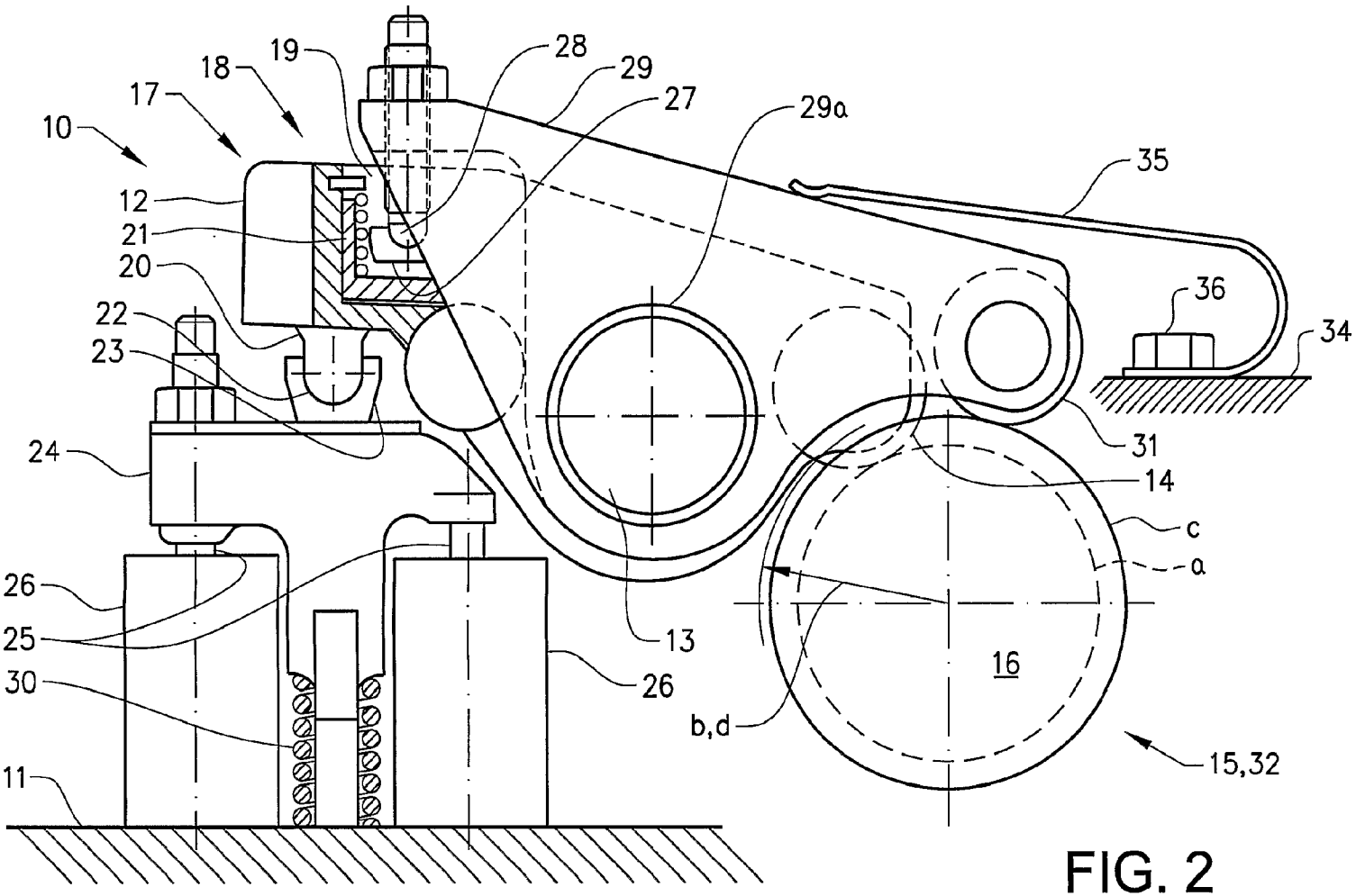
FIG. 2 is a side view of a second illustrative embodiment of the valve mechanism.

FIG. 2 shows a variant of the invention, in which the helically wound compression spring is replaced by a leaf spring 35 that is fixed to the engine by means of a screw 36. The leaf spring 35 has in principle the same point of engagement with the secondary rocker arm 29 as the coil spring 33.

In the present application, the use of terms such as "including" is open-ended and is intended to have the same meaning as terms such as "comprising" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

The invention must not be regarded as being restricted to the illustrative embodiments described above, but a range of further variants and modifications is conceivable within the scope of the following patent claims.

What is claimed is:

1. Exhaust valve mechanism for an internal combustion engine with at least one exhaust valve in each engine cylinder, comprising:

a main rocker arm for each cylinder mounted on a rocker arm shaft for normal operation of the exhaust valve by actuation of a camshaft with a cam element for each rocker arm;

a secondary rocker arm arranged on the main rocker arm and mounted on the rocker arm shaft for activation of an exhaust brake function, which activation is achieved through supply of hydraulic pressure to a piston cylinder which acts between both the main and secondary rocker arms and takes place through effect of one of the cam elements of the cam shaft; and a spring device arranged so as to act between a fixed point on the engine and the secondary rocker arm in such a way that the secondary rocker arm is caused by spring force to engage with the one of the cam elements, the spring device acting against the secondary rocker arm at a point which lies between a bearing shaft of the secondary rocker arm and a point of contact between the secondary rocker arm with the one of the cam elements.

2. Exhaust valve mechanism as claimed in claim 1, wherein the spring device acts against the secondary rocker arm at a point which lies essentially mid way between the bearing shaft and the contact point.

3. Exhaust valve mechanism as claimed in claim 2, wherein the contact point comprises a cam follower roller.

4. Exhaust valve mechanism as claimed in claim 1, wherein the contact point comprises a cam follower roller.

* * * * *

UNITED STATES PATENT AND TRADEMARK OFFICE

CERTIFICATE OF CORRECTION

PATENT NO. : 8,230,831 B2
APPLICATION NO. : 11/466473
DATED : July 31, 2012
INVENTOR(S) : Per Persson et al.

It is certified that error appears in the above-identified patent and that said Letters Patent is hereby corrected as shown below:

Title page, item 73, Assignee's name incorrectly spelled as "Volvo Lastuaguar AB" and should be spelled as --Volvo Lastvagnar AB--.

Signed and Sealed this
Twenty-eighth Day of August, 2012

David J. Kappos

David J. Kappos
*Director of the United States Patent and Trademark Office*